United States Patent [19]

Arff

[11] Patent Number: 4,492,047

[45] Date of Patent: Jan. 8, 1985

[54] CLEAT FOR SPORTS SHOES

[75] Inventor: Heino Arff, Hamburg, Fed. Rep. of Germany

[73] Assignee: ITW Ateco GmbH, Norderstedt, Fed. Rep. of Germany

[21] Appl. No.: 465,843

[22] Filed: Feb. 11, 1983

[30] Foreign Application Priority Data

Feb. 15, 1982 [DE] Fed. Rep. of Germany ..... 3205239
Nov. 18, 1982 [DE] Fed. Rep. of Germany ..... 3242606

[51] Int. Cl.[3] ..... A43C 15/02; A43C 15/16

[52] U.S. Cl. ..... 36/134; 36/62; 36/67 D

[58] Field of Search ..... 36/67 D, 62, 64, 67 R, 36/134

[56] References Cited

U.S. PATENT DOCUMENTS

| | | | |
|---|---|---|---|
| 2,294,462 | 9/1942 | King et al. | 36/67 D |
| 2,306,308 | 12/1942 | Goldenberg | 36/67 D |
| 2,309,783 | 2/1943 | Park | 36/67 D |
| 2,745,197 | 5/1956 | Holt | 36/67 D |
| 3,267,593 | 8/1966 | Turner | 36/67 D |
| 4,035,934 | 7/1977 | Hrivnak | 36/67 D |
| 4,357,763 | 11/1982 | Fleischmann et al. | 36/67 D |
| 4,366,632 | 1/1983 | Bente | 36/67 D |
| 4,414,763 | 11/1983 | Bente | 36/67 D |

FOREIGN PATENT DOCUMENTS

| | | | |
|---|---|---|---|
| 61715 | 10/1982 | European Pat. Off. | 36/134 |
| 2543268 | 3/1977 | Fed. Rep. of Germany | 36/67 D |

*Primary Examiner*—Werner H. Schroeder
*Assistant Examiner*—Steven N. Meyers
*Attorney, Agent, or Firm*—Thomas W. Buckman; Jack R. Halvorsen

[57] ABSTRACT

A cleat for sports shoes, especially football boots, comprising a socket situated in the outsole, a cleat body, a fastening attachment via which the cleat body is detachably connectible to the socket, and a supporting surface formed integrally with the cleat body thereat said supporting surface coming to lie in close contact against the outsole from below, with at least two circumferentially spaced downward pointing bearing surfaces formed at the fastening attachment which, upon insertion and after rotation of the fastening attachment through a predetermined angle of rotation come to lie in close contact against supporting surfaces in the socket under pressure, with the other supporting surface of the cleat body coming to lie in close contact against the outsole under a compression pressure, and with a means of safety against rotation provided between the fastening attachment and the socket.

17 Claims, 11 Drawing Figures

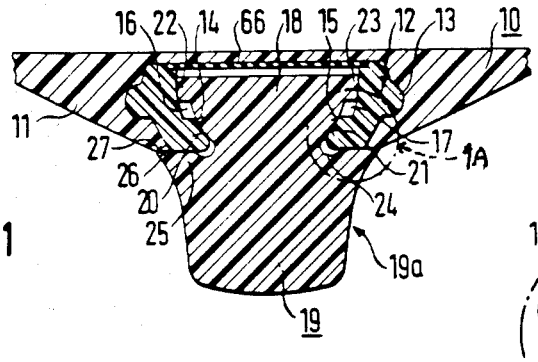
FIG. 1
FIG. 1A
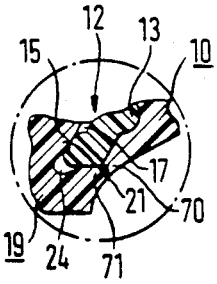
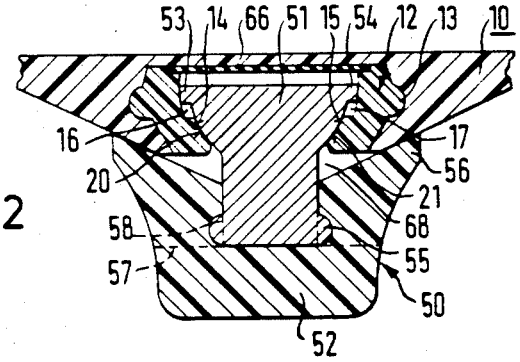
FIG. 2
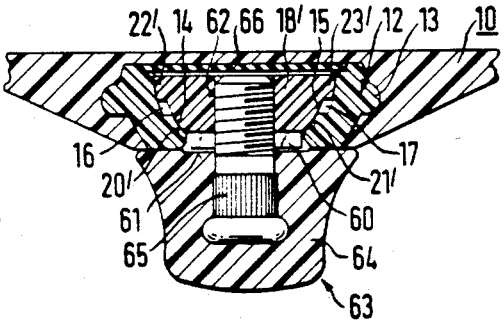
FIG. 3
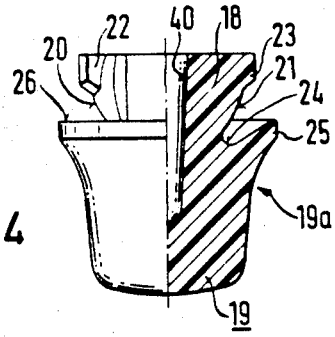
FIG. 4
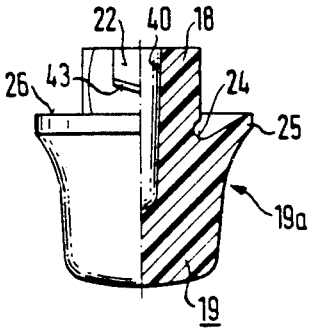
FIG. 5

CLEAT FOR SPORTS SHOES

BACKGROUND OF THE INVENTION

The invention relates to a cleat for sports shoes, especially football boots, comprising a socket situated in the outsole, a cleat body, a fastening attachment via which the cleat body is adapted to be detachably connected to the socket, and a supporting surface formed integrally at the cleat body said supporting surface coming to lie in close contact against the outsole from below.

With known cleats of the above type, there is a threaded bushing formed integrally in the outsole. The cleats have a threaded shank which is screwed into the threaded bushing. Depending on the nature of the bolt the cleats may be interchanged, the cleat bodies of which may consist of different material.

With the known cleats it is disadvantageous that in the case of a relatively hard material being used for the body cleat, the joints of a wearer will be subjected to high loads. Another drawback consists in that after greater abrasion the sharp-edged steel pin will be exposed and considerable injuries may be inflicted on partners and opponents. Finally, it is also disadvantageous that the pins and threaded inserts consisting of metal will substantially increase the weight of the boot.

SUMMARY OF THE INVENTION

It is the object of the invention to provide a cleat for sports shoes, especially football boots, with which the danger of injuries is reduced and the weight of the boot is decreased.

According to the invention this object is attained in that at least two circumferentially spaced downward pointing supporting surfaces are formed at the fastening attachment which upon insertion and after rotation, of the fastening attachment through a predetermined angle of rotation will come to lie under pressure against supporting surfaces in the socket, with the other supporting surface of the cleat body coming to lie under compression pressure against the outsole, and with a means of protection against rotation provided between the fastening attachment and the socket.

Also when using relatively hard material for the cleat body, the latter will always be more or less springy. The cleat according to the invention avails itself of this fact for rigidly connecting the cleat to the socket. The bearing and supporting surfaces form a sort of bayonet type closure, so that in the end position of rotation of the cleat body due to the tension between the cleat body and the underside of the outsole also the bearing and supporting surfaces are pressed against each other, whereby the cleat is fastly secured axially. A means of protection against rotation takes care that the cleat can no longer be rotated without substantial forces of rotation being applied.

So that the bearing and supporting surfaces may be brought into engagement with each other relatively easily provision is made according to one embodiment of the invention for fastening attachment to form with the socket an additional bayonet type closure which, during rotation of the fastening attachment for mounting purposes temporarily biases the supporting surfaces and the counter surfaces away from each other until they get into engagement with each other. The bayonet type closure may at the same time form a means of protection against rotation, thereby being axially relieved in the end position of rotation of the cleat. There are various constructional solutions imaginable for a bayonet type closure. In a preferred embodiment of the invention the socket is provided with paraxial slots through which the projections of the fastening attachment are introduced. The cleat may then subsequently be rotated following the axial insertion without any noticeable axial deformation of the cleat body. The projections in this arrangement are riding up on a ramp surface so that upon further rotation of the cleat body the supporting surface thereof will press itself against the outsole under increasing pressure and partial deformation of the cleat body. After the highest point of the upward sloping ramp surface has been passed, the projections may again perform an opposite movement by a certain degree. This preferably takes place owing to a downward sloping ramp surface following in the direction of rotation. True, the compression pressure of the supporting surface against the outsole is abating, but the projections are nevertheless not allowed to give way to the opposite axial movement of the cleat body in such an extent that the supporting surface still comes to lie only loosely in contact against the outsole. Rather, release is provided in such a degree only as to effect a sufficient interlocking of the radial projections at the fastening attachment with the supporting surface, however, still exerting a contact pressure against the outsole from below with a sufficient compression force.

The cleat body may be formed partially or completely of synthetic material thus considerably reducing the weight thereof. Furthermore, there is no danger of injuries even with a maximum degree of abrasion. Nevertheless, such a cleat can be inserted and removed, respectively, in the same simple manner as the known one.

According to a preferred embodiment of the invention the radial projections are disposed diametrically opposite each other. Theoretically, also more than two projections are imaginable. The ramp surfaces are, however, shortened in this manner.

A cleat formed in the manner according to the invention, above all when consisting of a relatively hard material may, however, be considered as being a relatively rigid unit which, for the wearer, above all in case of rotary movements, will become effective on the wearer's joints as a substantial torsional load. It is therefore another object of the invention to provide a cleat, especially for football boots, by which the loads on player are reduced. With a cleat of the type mentioned at the beginning this object is attained in that the fastening attachment forms a ball and socket joint with the socket.

The cleat described at the beginning is designed in such a manner that it may be interchanged, i.e. in case of wear, against a like one or one with a different material for the cleat body. The last mentioned cleat according to the invention is not restricted to interchangeable cleats. It is distinguished by the feature that the cleat body is supported in a manner to be capable of a pendulum movement and can perform limited pivotal movements in all directions. The extent of the pivotal movements in this arrangement is governed by the elastic deformation of the cleat body. In this manner the load on the walking mechanism of the wearer of the shoe is considerably mitigated.

What is especially advantageous is the connection of the fastening system according to the invention to the last mentioned pendulum type bearing of the cleat body.

In another embodiment of the invention provision is made in this connection for the bearing and supporting surfaces to be spherical surface sections and ball socket sections, respectively. As the projections must be introduced via corresponding slots in the insert member, it is possible only for ball surface sections and ball socket sections, respectively, to cooperate at any given time, in order to form a rotary joint with the socket. The joint surfaces, however suffice to provide the desired capability of the cleat body of limited pivotal movement in all directions.

In another embodiment of the invention provision is made for the radial projections to be formed by journals which, with the fastening attachment in its inserted condition are movably guided in paraxial radial recesses. The radial recesses follow the upward sloping ramp in the direction of rotation and loosely accommodate the journals, so that only a means of protection against rotation is secured by the engagement of journals in the recess but the journals are besides free to rotate and oscillate in the recesses. As the journals with the cleats in the inserted condition do not need to take over any forces, they may be dimensioned to be relatively weak.

According to another embodiment of the invention the fastening attachment and the cleat body may be formed in one piece, preferably of synthetic material. With this embodiment, the pendulum type bearing as described above becomes effective only in a reduced degree. In accordance with a further embodiment of the invention the cleat body is formed integrally at the fastening attachment or core which preferably consists of synthetic material. The fastening attachment thus is a separate member but is preferably form-closedly connected to the cleat body. The two members, therefore, may consist of materials differing in hardness. So, the cleat body may consist of an elastomeric material such as rubber, for example, while the fastening insert is formed of a relatively rigid material. With the aid of the resilient cleat body material it is possible to ensure an effective pendulum type suspension of the cleat.

According to a further embodiment of the invention provision is made for the fastening attachment to be a separate constructional member having an inner thread bore. The separate fastening attachment which may consist of synthetic material or metal may be inserted separately into the insert member so that now also conventional cleats with a threaded stud can be employed together with the system according to the invention.

For efficiently supporting the cleat body at the outsole provision is made in a further embodiment of the invention for the cleat body to have a radial flange directed obliquely in the direction of the outsole, said flange being relieved radially inward by an axial recess or a radial groove. In this manner, an increased resiliency of the cleat is obtained in the upper region.

For better supporting the cleat body provision is made in a further embodiment of the invention for an axially effective and a radially effective supporting surface to be formed respectively at the cleat body, said surfaces cooperating with the sole by corresponding counter surfaces provided at the sole.

The outsole, in accordance with a further embodiment of the invention, may be provided with an annular groove for the accommodation of a correspondingly shaped supporting portion of the cleat body. The said supporting portion may be formed inside an axial flange portion of the cleat body coming to lie into close contact against the outsole from below.

A further embodiment of the invention provides for a portion of elastomeric material to be formed at the underside of the cleat body. This portion of elastomeric material may be adjusted to the nature of the ground, indicating at the same time the respectively occurring wear, i.e. as soon as the remaining material of the cleat body appears the cleat must be replaced.

When using a separate insert member the latter, according to a further embodiment of the invention, is provided with a slot for a screw driver. In this manner, the insert member may be inserted into the reception bushing without causing any problems.

As with conventional cleats the cleat body has a toothing at the upper surface and the sole has a toothing at the underside, provision is made in a further embodiment of the invention for a toothing or the like to be formed at the underside of the bushing. This toothing will then get into engagement with the toothing of conventional cleat bodies or cleat bodies according to the invention.

The cleat according to the invention not only offers the many advantages as mentioned above but it also includes the great merit that its employment leaves the manufacturing process that has been utilized so far, unchanged. Said process is well known to consist in that when spraying the outsole onto the upper, insert members and cleats are in a given case likewise placed into the mold so that the insert member may be effectively embedded into the outsole, and in the proper place. Even if, with the cleat according to the invention, the insert member consists of synthetic material, the process may be performed in the same manner, i.e. insert member and cleat are placed into the injection mold before the outsole is sprayed onto the upper. The only prerequisite for this is that a covering be applied in the region of the insert member which will prevent soft synthetic material from getting between the insert member and the fastening attachment. This may be achieved, for example, with the aid of a sealing disc or the like.

For the manufacturing process it may also be advantageous if several reception bushings forming the socket are formed in one piece with the connection webs in accordance with the arrangement thereof at the outsole, and the reception bushings are embedded in the outsole together with the connection webs. All the bushings may simultaneously be placed into the mold. Individual connection webs may at the same time also form stiffening portions from the outsole.

In the following, some examples of embodiment of the invention will be explained in more detail by way of drawings.

BRIEF DESCRIPTION OF THE DRAWINGS

FIG. 1 shows a sectional view of a first embodiment of a cleat according to the invention in its mounted condition; this may at the same time represent the embodiment during production of the sole.

FIG. 1A is an enlarged fragmentary sectional view shown by the encircling broken line designated by the broken arrow 1A in FIG. 1.

FIG. 2 shows a sectional view of a second embodiment of a cleat according to the invention in its mounted condition.

FIG. 3 shows a sectional view of the combination of a cleat according to the invention with a conventional cleat.

FIG. 4 shows an embodiment of a fastening attachment for a cleat according to the invention.

FIG. 5 shows the cleat according to FIG. 4 after rotation through 90°.

DESCRIPTION OF THE PREFERRED EMBODIMENTS

Figure 6:
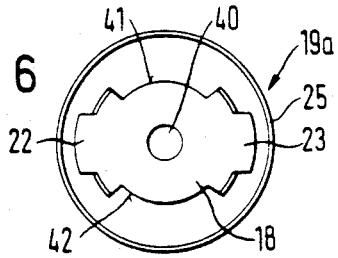
FIG. 6 shows the cleat according to FIG. 4 in a top plan view.

Prior to enlarging in more detail on the individual representations shown in the drawings, let it be stated that each of the features described and shown is of inventively essential importance by itself or in connection with features of the claims.

FIG. 1 shows a sectional view of an outsole 10 of a football boot, which, as will still be described in the following, is formed by spraying synthetic material against the upper. Embedded in a thickening 11 of the outsole 10 is an insert bushing 12 made of synthetic material which serves as a socket, and which is provided at the outside thereof with several circumferentially spaced radial projections 13 securing the bushing 12 against rotation. Details will still have to be dealt with in the following.

The bushing comprises two or more ball socket portions 14 and 15 disposed opposite each other. Formed above the ball socket portions are radial recesses 16 and 17, respectively, in diametrically opposed arrangement with respect to each other.

The bushing 12 receives inside a fastening attachment 18 of a cleat generally referenced **19*a* comprising a cleat body 19 formed integrally with the fastening attachment 18. The fastening attachment 18 has two or more diametrically opposed ball sections 20 and 21, respectively, cooperating with the ball socket portions 14, 15, so that a ball and socket joint is formed at this location. Formed integrally at the fastening attachment 18 above the ball sections 20, 21 are diametrically opposed journals 22 and 23, respectively, which are received by the radial recesses 16, 17**, and which have sufficient play in a downward sense.

A groove 24 formed between the fastening attachment 18 and the cleat body 19 forms a flange 25 like an annular cone extending in a direction towards the outsole 10. The lower inner end of the insert member 12 in this arrangement projects in part into the groove 24. An axial supporting surface 26 lies in close contact against a corresponding annular supporting surface 27 of the outsole 10.

Figure 7:
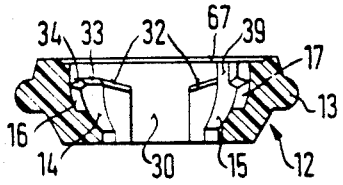
FIG. 7 shows a sectional view of an insert bushing of the cleat according to the invention.
Figure 8:
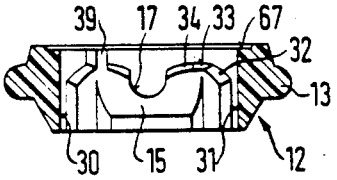
FIG. 8 shows the insert bushing according to FIG. 7 after rotation through 90°.
Figure 9:
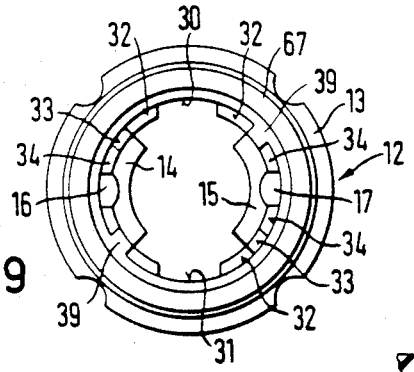
FIG. 9 shows the insert bushing according to FIG. 7 in a top plan view.

In FIGS. 7 to 9 the bushing is shown in more detail. It will be noted that diametrical slots 30, 31 are formed in the interior thereof. In the upper third of the slots 30, 31 upward sloping ramp surfaces 32 are formed at either side. Joining the surfaces 32 disposed to the right of the slot 30, 31 (in a counterclockwise sense) are horizontal or slightly downward sloping running surfaces 33. The radial recess mentioned before is respectively formed between two downward sloping ramp surfaces 34 with the bottom thereof disposed at a lower level than the latter.

The cleat **19*a* is shown in detail in FIGS. 4 to 6. It differs from the one shown in FIG. 1 in that it has a blind bore 40** formed therein from above which serves material saving purposes and to improve heat dissipation during cooling after injection molding.

It will furthermore be noted that the fastening attachment 18 is approximately spherically shaped but cylindrically recessed at 41 and 42, respectively, on opposite sides. It will furthermore be noted that that ramp surfaces 42 sloping upwards towards either side are formed at the underside of the journals 22, 23.

The assembly of the bushing 12 and cleat **19*a* according to FIGS. 4 and 9 to form the finished cleat according to FIG. 1 is as follows: The cleat 19*a* is introduced into the bushing 12 embedded in the sole 10 in such a manner that the journals 22, 23 may pass axially through the slots 30, 31. When the supporting surfaces 26, 27 of cleat 19*a* and outsole 10 are disposed against each other, the underside of the journals 22, 23 will have reached the upward sloping ramp surface 32 in the bushing 12. If, now, the cleat 19*a* is rotated in a clockwise sense, the ramp surfaces 42 will travel along the appertaining ramp surface 32. As, in this way, the cleat 19*a* is pulled further into the bushing 12, the flange 25 will become deformed such that the supporting surfaces 26, 27 come to lie against each other under substantial compression pressure. With the rotation of the ramp surfaces 42 continued, the latter will subsequently arrive on the downward sloping ramp surface 34 via the running surface 33, so that the spring tension in the flange 25 is slightly reduced but still suffices to take care of a sufficient contact pressure of the flange against the outsole. The cleat 19*a* is now rotated further a distance until the journals 22, 23 are aligned with respect to the radial recesses 16, 17. In the case being described the underside of the journals 22, 23 snaps into the recess 16, 17, in order to define a position of rotation. When loosening the cleat 19*a* a rotary movement is performed in a backward sense until the journals 22, 23 are again aligned with the slot 30, 31. Round journals which are received more or less loosely by the recesses 16, 17 may also be utilized instead of the journals 22, 23**.

The arrangement as described of the fastening attachment 18 and the socket 12 results in a cooperation of the spherical surfaces 20, 21 and the ball socket portions 14, 15 for the purpose of forming a ball and socket joint upon snapping engagement of the journals 22, 23 adjacent the recesses 16, 17. Thus, the cleat **19*a* is received by the bushing 12 more or less in the manner of a pendulum, with the pivotal movement in all directions limited by the elasticity of the material of the cleat 19*a***.

With the insertion of the cleat **19*a* as described above, abutments 39 in the bushing 12** limit the rotary movement.

In the embodiment according to FIG. 2 a bipartite cleat 50 is provided having a fastening attachment 51 and a cleat body 52 of elastomeric material. The material of the fastening attachment 51 is composed of a harder material. The outsole 10 and the bushing 12 are formed in the same manner as with the embodiment according to FIG. 1, so that it is not intended here to enlarge any more on details. It will be noted that the fastening attachment 51 has diametrically opposed journals 53, 54 dimensioned to be relatively thin and which are seated in the radial recesses 16, 17 of the bushing 12. They are received by the recesses 16, 17 relatively loosely so that with the aid of the cooperating spherical and ball socket portions a free pendulum type movement of the fastening attachment 51 is made possible.

The lower portion of the fastening attachment 51 which is approximately cylindrically shaped and designed in the manner of a shank is provided with one or several radial beads 55 at the underside thereof. The cleat body 52 of elastomeric material is vulcanized onto the shank or buttoned thereto and, with the aid of the bead 55, is safely retained at the fastening attachment 51. The cleat body 52 has again a flange 56 in the shape of an annular cone which comes to lie in close contact against the underside of the outsole 10 with the elastomeric material subjected to a bias after insertion of the cleat 52.

By the broken lines 57 and 58, respectively, it is intended to indicate that the fastening attachment 52 may be shaped in the manner of a mushroom and may form part of the cleat body. This mushroom-like fastening attachment may consist of a relatively hard material, while the portion disposed thereabove which is separated therefrom or vulcanized thereto, consists of an elastomeric material in order to bring about a sufficient resilient effect.

In the embodiment according to FIG. 3 a socket is used or a bushing 12 which resembles the one according to FIGS. 1 and 2. Therefore, like parts are provided with like reference numerals. Furthermore, a fastening attachment is used which is of the same construction as the one according to FIG. 1, but which is formed as a separate member. Therefore, all parts similar to FIG. 1 are provided with the same reference numerals but primed. The annular fastening attachment 18' is provided with a slot 60 for a screw driver on the underside thereof as well as with a toothing 61 not shown in any more detail. It is furthermore provided with a threaded bore 62. A conventional cleat 63 consists of a cleat body 64 and a threaded stud 65 embedded therein. With the aid of the threaded stud 65 the cleat 63 may be screwed into the fastening attachment 18'. In this manner, also conventional threaded cleats may be combined with the system as described. If the cleat body 64 consists of a resiliently elastic material, the ball and socket joint connection between attachment 18' and bushing 12 may again come into effect.

In the manufacture of the cleat as described it will be started out suitably from the embodiment according to FIG. 1. The pre-assembled system of bushing 12 and cleat **19*a* is placed into the injection mold as hitherto usual together with the upper. Following this, the outsole 10 is sprayed or injection molded with the aid of a suitable synthetic material. A suitable covering (not shown) prevents synthetic material from penetrating between bushing 12 and fastening attachment 18**.

If desired, the cleat **19*a* may be removed and replaced by another one, for example, by one according to FIG. 2. If, however, it is desired to select a conventional cleat according to FIG. 3, a modified fastening attachment 18'** must be selected.

The sealing disc 66 may be formed in one piece with the bushing 12 and tied thereto via a film type hinge.

Figure 10:
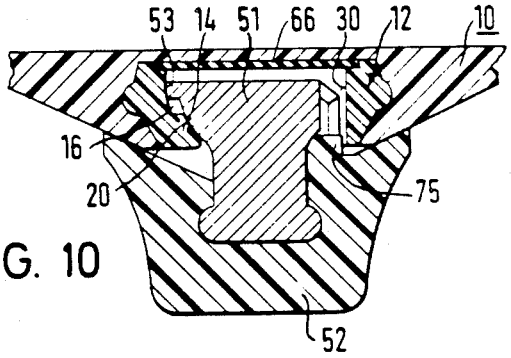
FIG. 10 shows a similar representation as FIG. 2 but with an additional means of safety against rotation.

The representation according to FIG. 10 essentially resembles that according to FIG. 2. Therefore, like parts are provided with like reference numerals. However, what is involved with the representation according to FIG. 10 is a sectional view arranged at an angle of 90° so that the slot 30 will be recognized on the right hand side in FIG. 10 via which the journal 54 (not shown) may enter. The cleat body 52 is provided with an axial projection 75 which with the cleat in its condition of being fitted will engage within the slots 30, 31 and will form thereby a means of protection against rotation. In the process of fitting the projection 75 abuts against the underside of the bushing 12. For fitting the cleat, therefore, the projection 75 must first be deformed before it may expand into the slots 30 and 31, respectively, when the cleat has reached its final position of rotation. It goes without saying that the cleat body 52 must consist of a sufficiently elastomeric material so that the desired deformation may take place.

Figure 11:
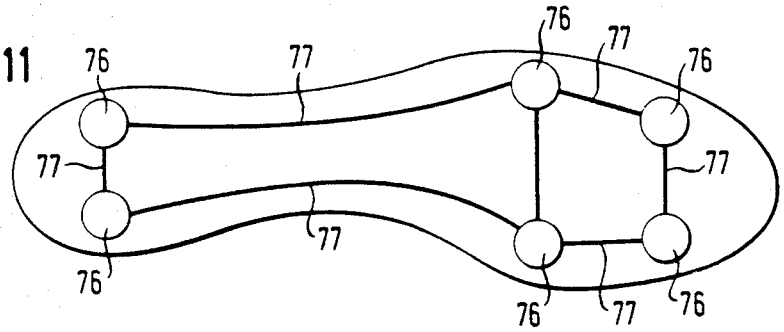
FIG. 11 shows schematically the arrangement of the cleats at an outsole, connected through individual connection webs.

In FIG. 11, the entire outsole 10 is shown in a bottom plan view. The arrangement of the individual insert bushings 76 is very well recognizable. The individual insert bushings 76 are interconnected via connection webs 77 which are formed integrally with the bushings 76 formed of synthetic material. The grid formed in this manner may be placed into the mold when forming the outsole, with the webs 77 fixing the geometrical arrangement of the bushings 76 with respect to each other. Individual connection webs may be reinforced and may serve as stiffening portions for the outsole 10.

I claim:

1. A cleat for sports shoes, especially football boots, comprising a socket situated in the outsole, a cleat body, a fastening attachment via which the cleat body is detachably connectible to the socket, and a supporting surface formed at the cleat body which comes to lie in close contact against the outsole from below, characterized in that at least two circumferentially spaced downward pointing mounting surfaces are formed at the fastening attachment and after rotation thereof through a predetermined angle of rotation come to lie in close contact under pressure against supporting surfaces in the socket, with the other supporting surface of the cleat body lying under compression pressure against the outsole and with a means of protection against rotation provided between the fastening attachment and the socket, said fastening attachment forming a ball and socket joint with said socket.

2. A cleat according to claim 1, characterized in that the fastening attachment forms the bayonet type closure with the aid of slots of the socket aligned with projections such that the projections upon rotation of the inserted fastening attachment will ride up an upward sloping ramp surface and subsequently will move along a downward sloping portion.

3. A cleat according to claim 2, characterized in that radial projections are formed by journals which, with the fastening attachment in its inserted condition are movably guided in paraxial radial recesses.

4. A cleat according to claim 1, characterized in that the cleat body is connectible to the ball and socket joint ball via a threaded connection.

5. A cleat according to claim 1, characterized in that the cleat body is provided with a flange extending radially obliquely in the direction towards the outsole, said flange being relieved radially inward by an axial recess or a radial groove.

6. A cleat according to claim 5, characterized in that the cleat body consisting of an elastomeric material is provided with at least one axial projection at the side facing the reception socket, said projection with the cleat body in its end position being aligned with a recess of the reception socket and engaging therein.

7. A cleat according to claim 6, characterized in that the cleat body has formed thereat an axially effective and a radially effective supporting surface cooperating with corresponding counter surfaces at the sole.

8. A cleat according to claim 16, characterized in that the outsole has an interrupted annular groove formed therein for the reception of a correspondingly shaped supporting portion 13 of the cleat body.

9. A cleat according to claim 8, characterized in that an axial flange portion of the cleat body forms a supporting portion engaging within the groove, while a radial flange portion radially projects above the axial flange portion coming to lie in close contact against the outsole.

10. A cleat according to claim 1, characterized in that a slot 60 for a screw driver is formed at the underside of the socket.

11. A cleat according to claim 1, characterized in that the underside of the cleat body has a portion of elastomeric material integrally formed thereat.

12. A cleat according to claim 1, characterized in that the socket is formed by a bushing and is provided with several circumferentially spaced radial projections at the outer surface thereof.

13. A cleat according to claim 12, characterized in that the underside of the bushing and the facing supporting surface of the cleat body have formed thereat with a toothing or the like.

14. A cleat according to claim 13, characterized in that the upper surface of the socket or bushing has formed therein a deepening for the reception of a sealing disc.

15. A cleat according to claim 14, characterized in that the sealing disc is integrally formed with the bushing via a film type hinge.

16. A cleat according to claim 12, characterized in that several reception bushings forming an equal number of sockets are integrally formed with connecting webs corresponding to their desired arrangement in the outsole and the reception socket together with the connecting webs are embedded in the outsole.

17. A cleat according to claim 26, characterized in that at least one connecting web serves as a stiffening portion for the outsole.

* * * * *